US011525340B2

(12) United States Patent
Langlais et al.

(10) Patent No.: US 11,525,340 B2
(45) Date of Patent: Dec. 13, 2022

(54) SYSTEM AND METHODOLOGY FOR HIGH PRESSURE ALTERNATE PATH

(71) Applicant: Schlumberger Technology Corporation, Sugar Land, TX (US)

(72) Inventors: Michael Dean Langlais, Houston, TX (US); Michael Robbins, Voghera (IT)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 155 days.

(21) Appl. No.: 16/965,355

(22) PCT Filed: Jan. 29, 2019

(86) PCT No.: PCT/US2019/015514
§ 371 (c)(1),
(2) Date: Jul. 28, 2020

(87) PCT Pub. No.: WO2019/148152
PCT Pub. Date: Aug. 1, 2019

(65) Prior Publication Data
US 2021/0123327 A1 Apr. 29, 2021

Related U.S. Application Data

(60) Provisional application No. 62/623,376, filed on Jan. 29, 2018.

(51) Int. Cl.
*E21B 43/08* (2006.01)
*E21B 17/18* (2006.01)
(Continued)

(52) U.S. Cl.
CPC ..... *E21B 43/08* (2013.01); *E21B 17/1078* (2013.01); *E21B 17/18* (2013.01); *E21B 43/04* (2013.01)

(58) Field of Classification Search
CPC ..... E21B 17/1078; E21B 17/18; E21B 43/04; E21B 43/08
See application file for complete search history.

(56) References Cited

U.S. PATENT DOCUMENTS 7,562,709 B2 7/2009 Saebi et al.
8,403,046 B2 * 3/2013 Nutley ..... E21B 43/04 166/278
(Continued)

FOREIGN PATENT DOCUMENTS

WO 2013187878 A1 12/2013
WO 2017155546 A1 9/2017

OTHER PUBLICATIONS

International Preliminary Report on Patentability issued in the PCT Application PCT/US2019/015514, dated Aug. 13, 2020 (8 pages).
(Continued)

*Primary Examiner* — Catherine Loikith
(74) *Attorney, Agent, or Firm* — Matthew Goode

(57) ABSTRACT

A technique facilitates formation of a gravel pack along relatively lengthy wellbores. According to an embodiment, a completion system comprises a plurality of screen assemblies. The completion system also has an alternate path system disposed along the plurality of screen assemblies. The alternate path system includes shunt tubes, e.g. transport tubes, coupled together by jumper tubes. An anti-buckling structure is coupled to each jumper tube to prevent buckling when high operational pressures, e.g. operating pressures of 9000 psi or higher, are applied to the alternate path system.

9 Claims, 8 Drawing Sheets

(51) Int. Cl.
*E21B 43/04* (2006.01)
*E21B 17/10* (2006.01)

(56) References Cited

U.S. PATENT DOCUMENTS

| | | | | |
|---|---|---|---|---|
| 8,967,240 | B2 * | 3/2015 | Cunningham | E21B 43/086 166/278 |
| 2008/0277114 | A1 | 11/2008 | Corbett et al. | |
| 2009/0133874 | A1 | 5/2009 | Dale et al. | |
| 2009/0188674 | A1 | 7/2009 | Guignard et al. | |
| 2010/0314109 | A1 | 12/2010 | Garcia et al. | |
| 2012/0168159 | A1 | 7/2012 | Edwards et al. | |
| 2013/0181441 | A1 | 7/2013 | Courpet et al. | |
| 2013/0255943 | A1 * | 10/2013 | Yeh | E21B 43/045 166/305.1 |
| 2014/0110131 | A1 | 4/2014 | Cunningham et al. | |
| 2015/0308238 | A1 | 10/2015 | Langlais | |
| 2016/0215570 | A1 | 7/2016 | Molina | |

OTHER PUBLICATIONS

International Search Report and Written Opinion issued in the PCT Application PCT/US2019/015514, dated May 1, 2019 (11 pages).
Combined Search and Examination Report issued in GB application 1901214.5, dated Jun. 4, 2019 (5 pages).
Office Action issued in Azerbaijan patent Application No. a 2020 0064 dated Jul. 8, 2021, 6 pages with English translation.

* cited by examiner

REPLACEMENT SHEET

7/8

SYSTEM AND METHODOLOGY FOR HIGH PRESSURE ALTERNATE PATH

CROSS-REFERENCE TO RELATED APPLICATION

This application is based on and claims priority to U.S. Provisional Application Ser. No. 62/623,376, filed Jan. 29, 2018, which is incorporated herein by reference in its entirety.

BACKGROUND

Gravel packs are used in wells for removing particulates from inflowing hydrocarbon fluids. Generally, a completion having a sand screen assembly or a plurality of sand screen assemblies is deployed downhole in a wellbore and a gravel pack is formed around the completion. To facilitate the gravel pack, the completion may include an alternate path system to help prevent premature slurry dehydration in open hole gravel packs. Alternate path screen assemblies are used for gravel packing open hole wells having lengths which traditionally have not exceeded 3000 feet. An alternate path system utilizes shunt tubes, e.g. transport tubes, which provide an alternate path for gravel slurry delivery. Jumper tubes are used to couple the shunt tubes between sequential sand screen assemblies.

To move the gravel slurry through the transport tubes, a sufficient operating pressure is applied to overcome friction pressures experienced during the gravel pack. A rule of thumb for friction pressure is approximately 1 psi/foot so that gravel packing a length of 3000 feet involves application of an operating pressure of at least 3000 psi. Consequently, the alternate path system is constructed to have an operating pressure capacity of at least 3000 psi. In recent years, the demand for gravel pack lengths exceeding 3000 feet has become more common. Today, operators are seeking to save operating costs by reducing the number of wells drilled in favor of increasing the length of the wells to cover the same footprint. Such changes led to extending alternate path capability to gravel pack lengths exceeding 5000 feet, commonly referred to as extended reach gravel packs. Current alternate path systems often have operating pressure limits of around 5000 psi. When higher operating pressures are applied to existing alternate path systems, there is a higher risk of jumper tube buckling within the alternate path systems.

SUMMARY

In general, a system and methodology are provided for facilitating formation of a gravel pack along relatively lengthy wellbores. According to an embodiment, a completion system comprises a plurality of screen assemblies. The completion system also has an alternate path system disposed along the plurality of screen assemblies. The alternate path system includes shunt tubes, e.g. transport tubes, coupled together by jumper tubes. According to one or more embodiments of the disclosure, an anti-buckling structure is coupled to each jumper tube to prevent buckling when high operational pressures, e.g. operating pressures of 9000 psi or higher, are applied to the alternate path system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology to facilitate formation of gravel packs in wellbores and thus the subsequent production of well fluids. A well completion is provided with an alternate path system, e.g. a shunt tube system, for carrying gravel slurry along an alternate path so as to facilitate improved gravel packing during a gravel packing operation. The system and methodology are very useful for facilitating formation of a gravel pack along relatively lengthy wellbores.

According to an embodiment, a completion system comprises a plurality of screen assemblies. The completion system also has an alternate path system disposed along the plurality of screen assemblies. The alternate path system includes shunt tubes, e.g. transport tubes, coupled together by jumper tubes. For example, an alternate path system may be comprised of shunt tubes running externally to sand screens of the screen assemblies and generally parallel with a base pipe running through the sand screens. The shunt tubes generally terminate within a few feet from each end of the base pipe of the downhole completion. Terminating the shunt tubes a sufficient distance away from the ends of the base pipe provides sufficiently long base pipe ends which are exposed for gripping when sequential alternate path screen assemblies are coupled together on a rig. Once the alternate path screen assemblies are made-up, the sequential alternate path shunt tubes are joined by a corresponding jumper tubes.

The shunt tubes may have various sizes and configurations. In some applications, however, the shunt tubes are generally rectangular in cross-section and the jumper tubes are generally circular in cross-section. The jumper tubes are each coupled with an anti-buckling structure to prevent buckling when high operational pressures are applied to the alternate path system. Examples of high operational pressures are pressures above 5000 psi and sometimes 9000 psi or higher.

Figure 1:
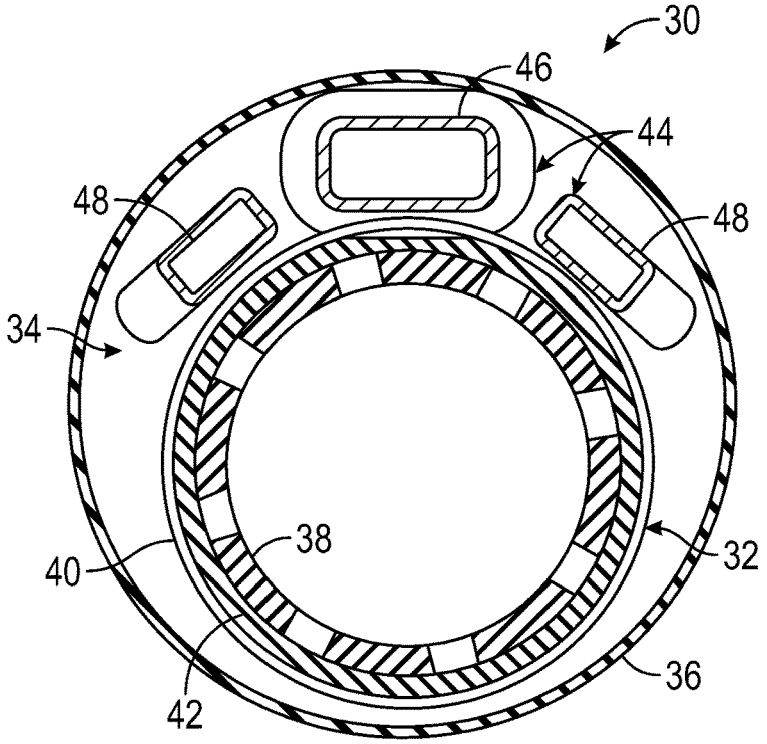
FIG. 1 is a schematic cross-sectional illustration of an example of a downhole completion having a screen assembly with alternate path system, according to an embodiment of the disclosure.
Figure 2:
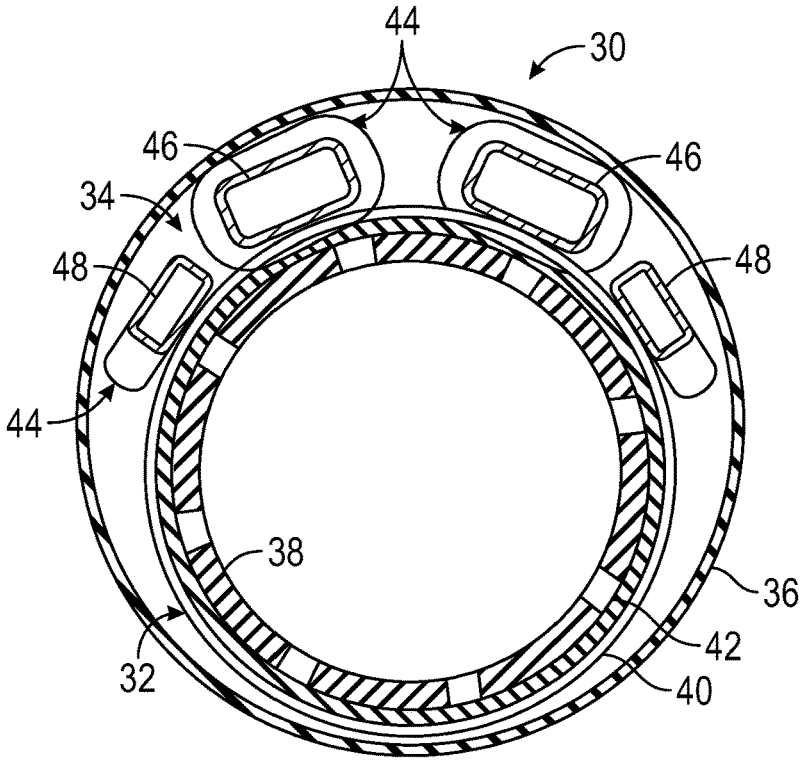
FIG. 2 is a schematic cross-sectional illustration of another example of a downhole completion having a screen assembly with alternate path system, according to an embodiment of the disclosure.

Referring generally to FIGS. 1 and 2, examples of downhole completions 30 are illustrated as combining a sand screen assembly 32 with an alternate path system 34 which is surrounded by a shroud 36. By way of example, each sand screen assembly 32 may comprise a base pipe 38 surrounded by a sand screen 40 and separated from the sand screen 40 by a drainage layer 42. The alternate path system 34 may be disposed externally of the sand screen 40 and may comprise shunt tubes 44, such as transport tubes 46 and packing tubes 48. In the embodiment illustrated in FIG. 2, the alternate path system 34 comprises a greater number of transport tubes 46, e.g. two transport tubes, positioned generally alongside each other within shroud 36.

Figure 6:
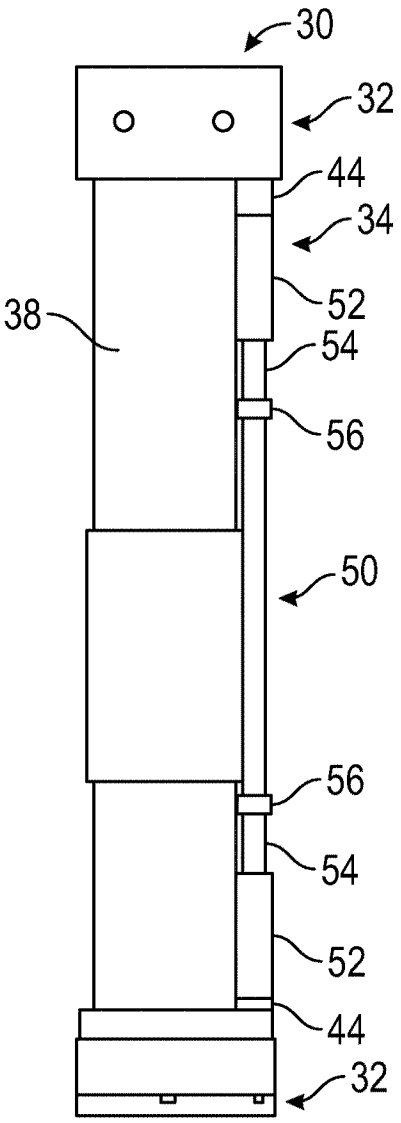
FIG. 6 is an illustration of a jumper tube being installed into an alternate path system between shunt tubes of sequential sand screen assemblies, according to an embodiment of the disclosure.
Figure 5:
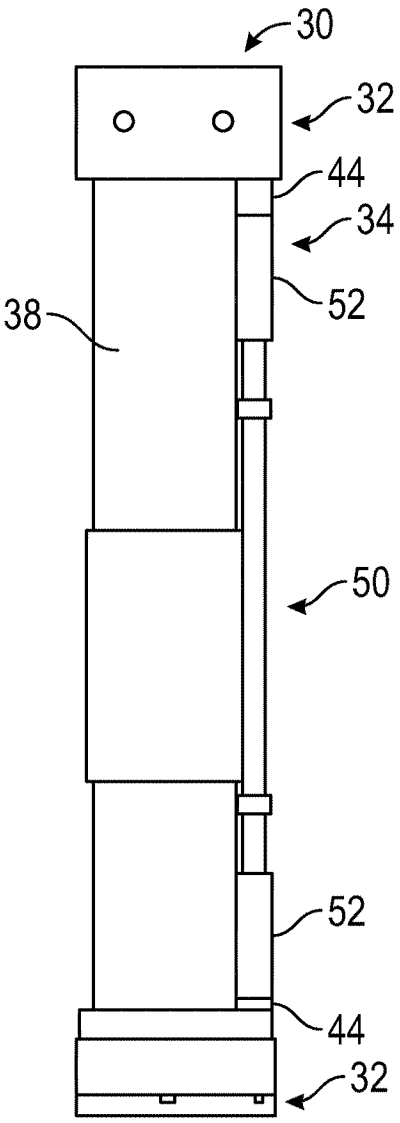
FIG. 5 is an illustration of a jumper tube being installed into an alternate path system between shunt tubes of sequential sand screen assemblies, according to an embodiment of the disclosure.
Figure 4:
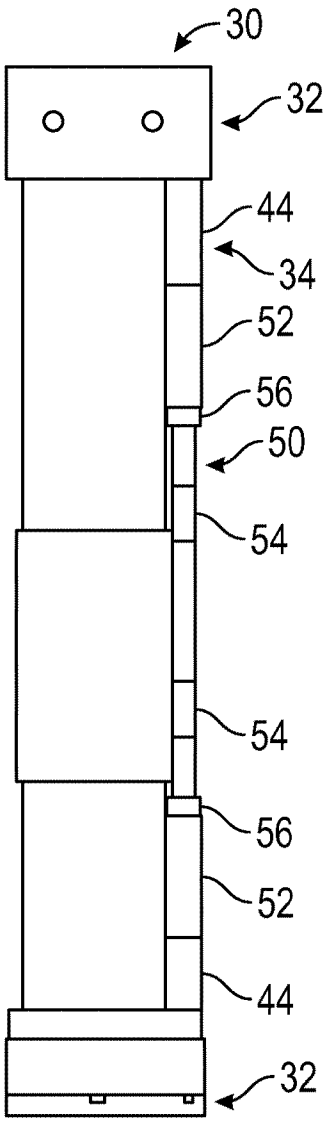
FIG. 4 is an illustration of a jumper tube being installed into an alternate path system between shunt tubes of sequential sand screen assemblies, according to an embodiment of the disclosure.
Figure 3:
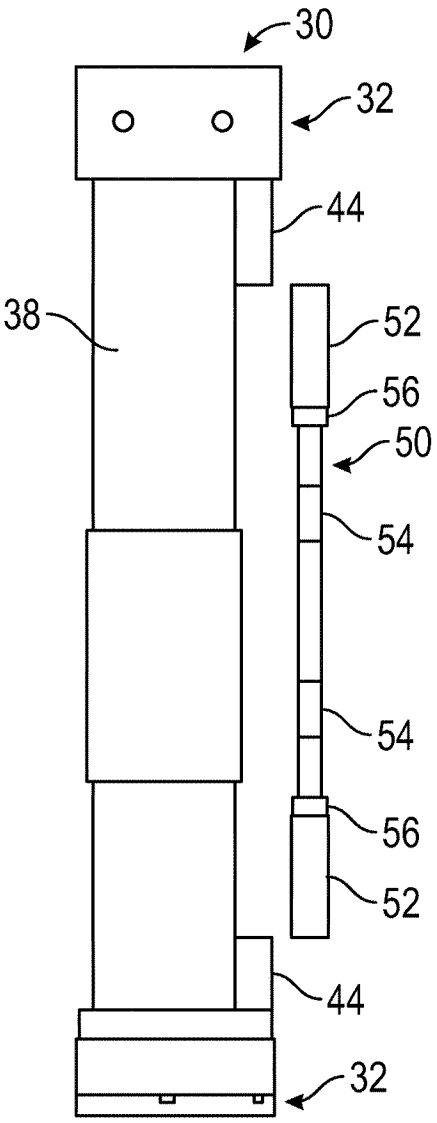
FIG. 3 is an illustration of a jumper tube being installed into an alternate path system between shunt tubes of sequential sand screen assemblies, according to an embodiment of the disclosure.

With reference to FIGS. 3-7, an example is provided in which sequential sand screen assemblies 32 are coupled together, and corresponding shunt tubes 44 of the sequential sand screen assemblies 32 are joined by a corresponding jumper tube 50. By way of example, each jumper tube 50 may comprise connectors 52 disposed at opposite ends of the jumper tube 50 to enable coupling with corresponding shunt tubes 44, e.g. transport tubes 46, of the sequential sand screen assemblies 32. Each jumper tube 50 may comprise other features to facilitate coupling, such as the illustrated snap on clips 54 and clip stops 56 which may be used to secure connectors 52 to the ends of corresponding shunt tubes 44, as illustrated in FIGS. 4-6.

Figure 7:
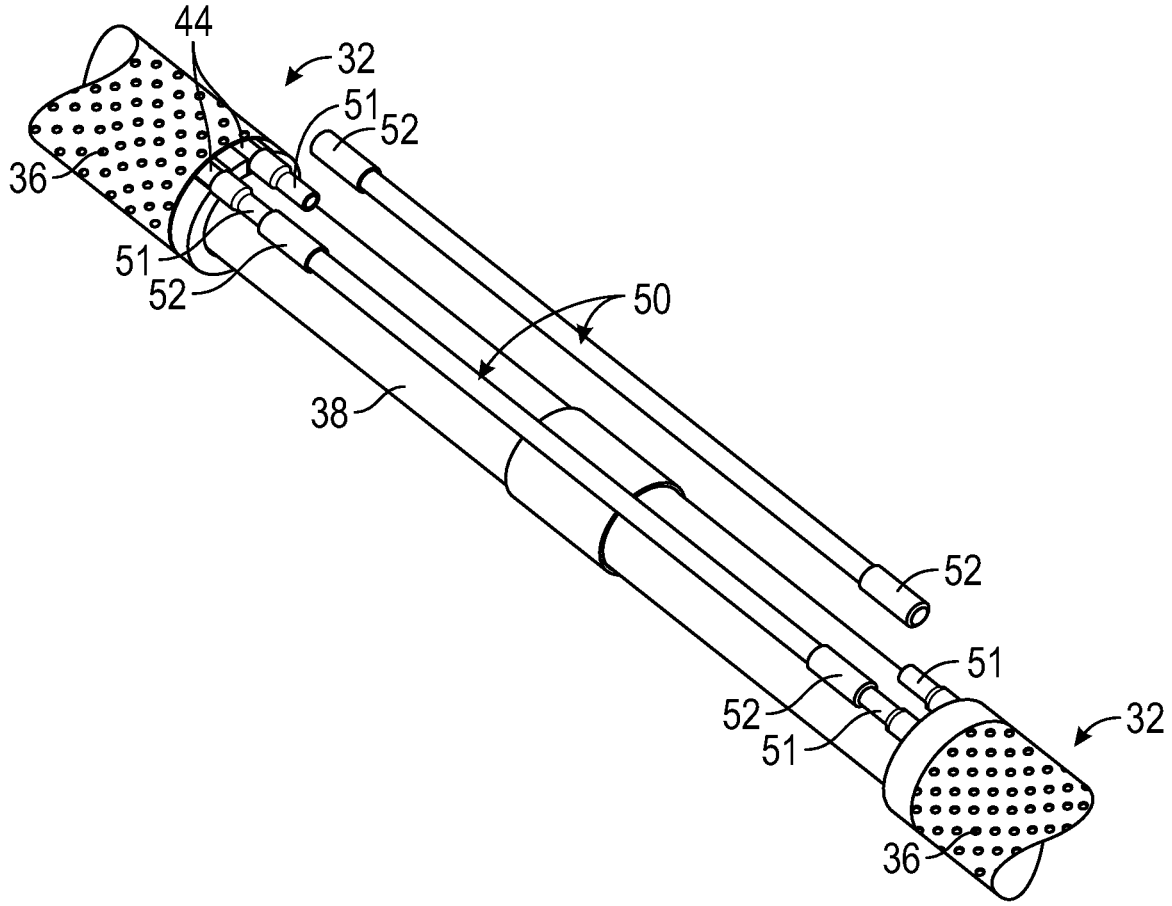
FIG. 7 is an illustration of a jumper tube being installed into an alternate path system between shunt tubes of sequential sand screen assemblies, according to an embodiment of the disclosure.
Figure 8:
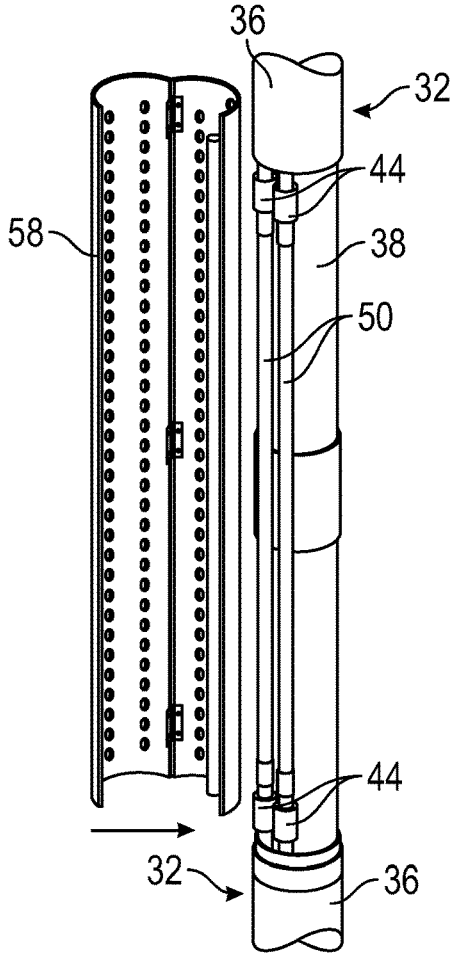
FIG. 8 is an illustration of a shroud being installed around jumper tubes located between shunt tubes of sequential sand screen assemblies, according to an embodiment of the disclosure.

With additional reference to FIG. 7, some embodiments may utilize shunt tubes 44 having a generally rectangular cross-section to facilitate placement under shroud 36 and the jumper tubes 50 may have a generally circular cross-section to avoid the tendency of rectangular tubes to deform towards a rounder shape under high internal pressure. Such deformation can lead to loss of pressure containment. In this latter type of embodiment, each transition 51 has a generally rectangular end and a generally circular end to facilitate coupling with the corresponding rectangular shunt tube 44 and circular jumper tube 50 via the connector 52.

It should be noted the use of shunt tubes having a rectangular shape facilitates minimization of the overall outside diameter of the completion while helping maximize the size/diameter of the base pipe—which can be important in many types of oilfield applications. Thus, although the rectangular shape may not be desirable for pressure containment, the rectangular shape helps maximize base pipe diameter for a given wellbore size. However, in the longitudinal space between sand screens 40 at the joint-to-joint connection between sequential sand screen assemblies 32, there is no underlying sand screen. This provides substantially more physical space to accommodate jumper tubes 50 having generally round cross-sections while providing the same internal flow area as the rectangular shunt tubes 44, e.g. transport tubes 46, disposed along the screen assemblies 32. Consequently, the jumper tubes 50 may have a desirable rounded cross-section for pressure containment while providing similar flow area as the rectangular shunt tubes 44. The consistent flow area results in no or limited slurry acceleration (and thus no increased erosion risk) through the jumper tubes 50.

Figure 9:
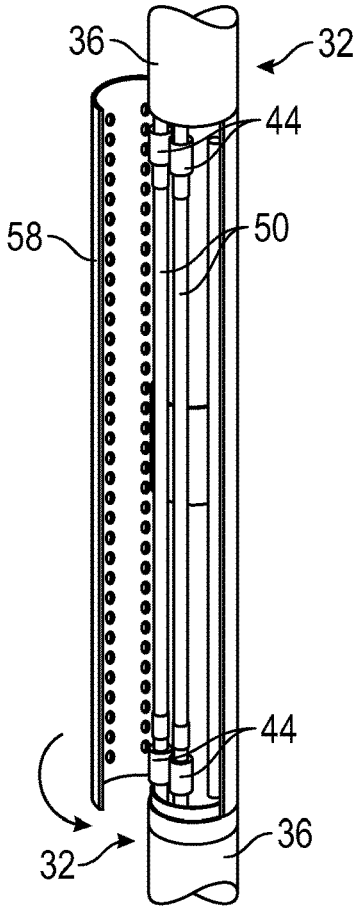
FIG. 9 is an illustration of a shroud being installed around jumper tubes located between shunt tubes of sequential sand screen assemblies, according to an embodiment of the disclosure.
Figure 10:
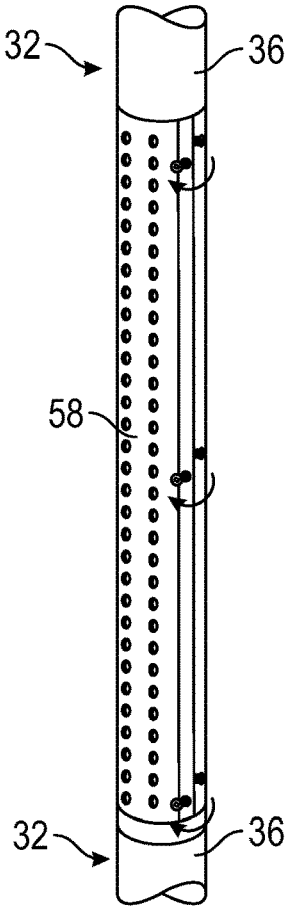
FIG. 10 is an illustration of a shroud being installed around jumper tubes located between shunt tubes of sequential sand screen assemblies, according to an embodiment of the disclosure.
Figure 11:
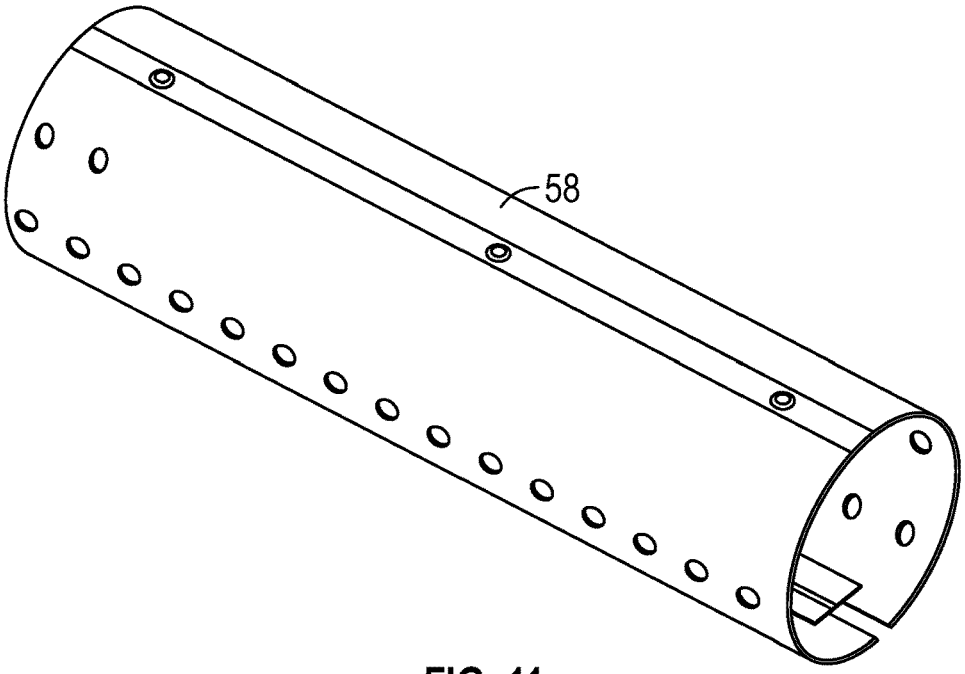
FIG. 11 is an illustration of an example of a shroud, according to an embodiment of the disclosure.
Figure 12:
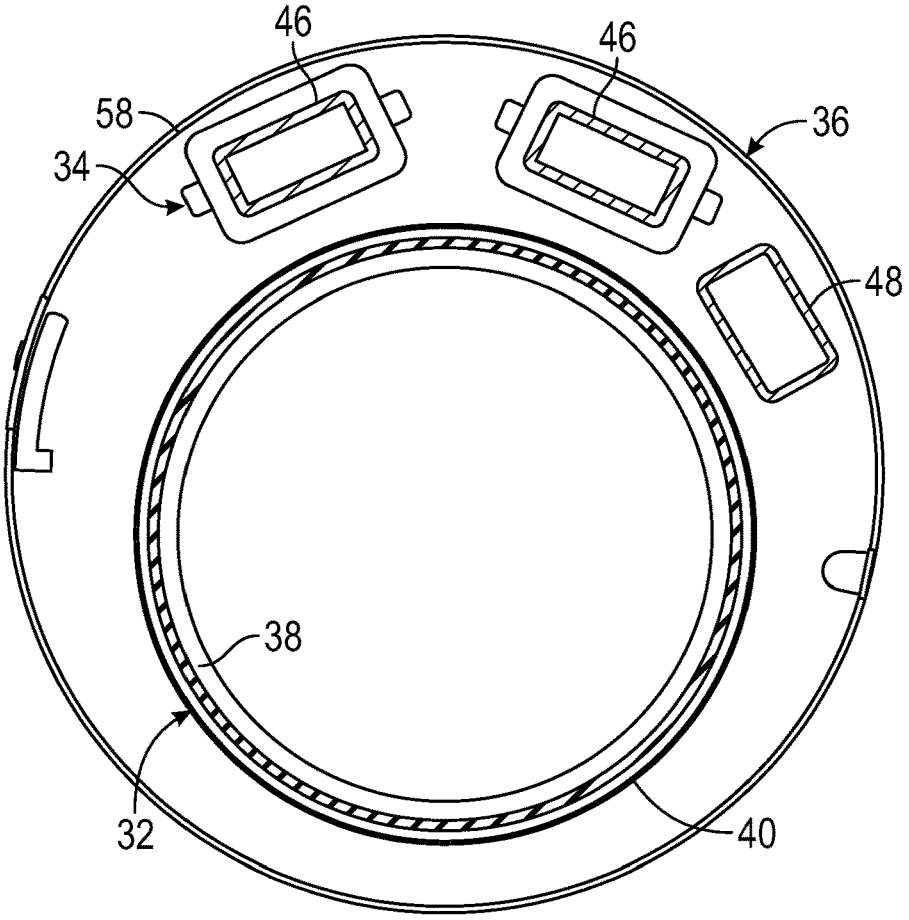
FIG. 12 is a cross-sectional illustration showing shunt tubes disposed radially between a base pipe and a shroud, according to an embodiment of the disclosure.
Figure 13:
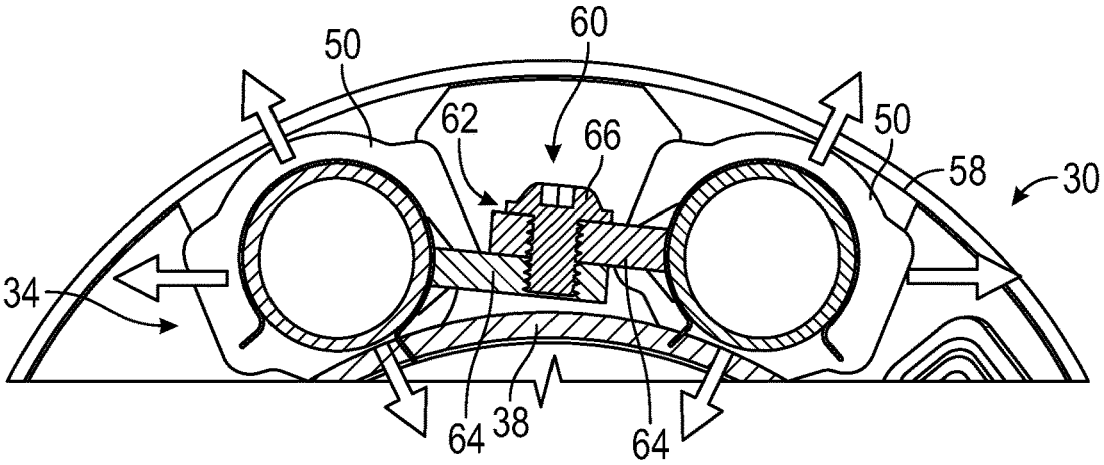
FIG. 13 is a cross-sectional illustration of adjacent jumper tubes combined with an anti-buckling structure, according to an embodiment of the disclosure.

As illustrated in FIGS. 8-12, a shroud 58 may be positioned around the base pipe 38 and the jumper tubes 50 between sequential shrouds 36 of sequential screen assemblies 32. By way of example, the shroud 58 may be in the form of a split shroud which may be closed around the corresponding jumper tubes 50 and secured into the completion 30, as illustrated in FIGS. 9 and 10. The shrouds 36, 58 cooperate with the base pipe 38 to support the shunt tubes 44 and jumper tubes 50 in a radial direction. As illustrated in FIG. 12, for example, the shroud 36 and the base pipe 38 work in cooperation with the rectangular shunt tubes 44 to prevent radially outward buckling and radially inward buckling.

The shroud 58, e.g. a split shroud, works in a similar manner to provide support against radially outward buckling and radially inward buckling of the corresponding jumper tubes 50. However, when the jumper tube 50 is a round tube having a generally round cross-sectional configuration, the direction of buckling is potentially in infinite directions. Accordingly, an anti-buckling structure 60 is coupled with each jumper tube 50 to provide lateral restraint in addition to the radial restraint provided by the base pipe 38 and the shroud 58.

An embodiment of the anti-buckling structure 60 is illustrated in FIGS. 13-17. Use of the anti-buckling structure 60 limits or prevents buckling of the jumper tubes 50 without increasing the wall thickness of the jumper tubes 50. In this example, laterally adjacent jumper tubes 50 are connected by anti-buckling structure 60 which may be in the form of a plate 62 affixed to the side wall of each adjacent jumper tube 50. Effectively, the plate 62 couples the two adjacent jumper tubes 50, enabling each tube to take advantage of the material strength afforded by the other jumper tube 50. By way of example, each jumper tube 50 may be connected with a narrow, long plate portion 64 having a length from, for example, 50% to 95% of the length of the jumper tubes 50.

Figure 14:
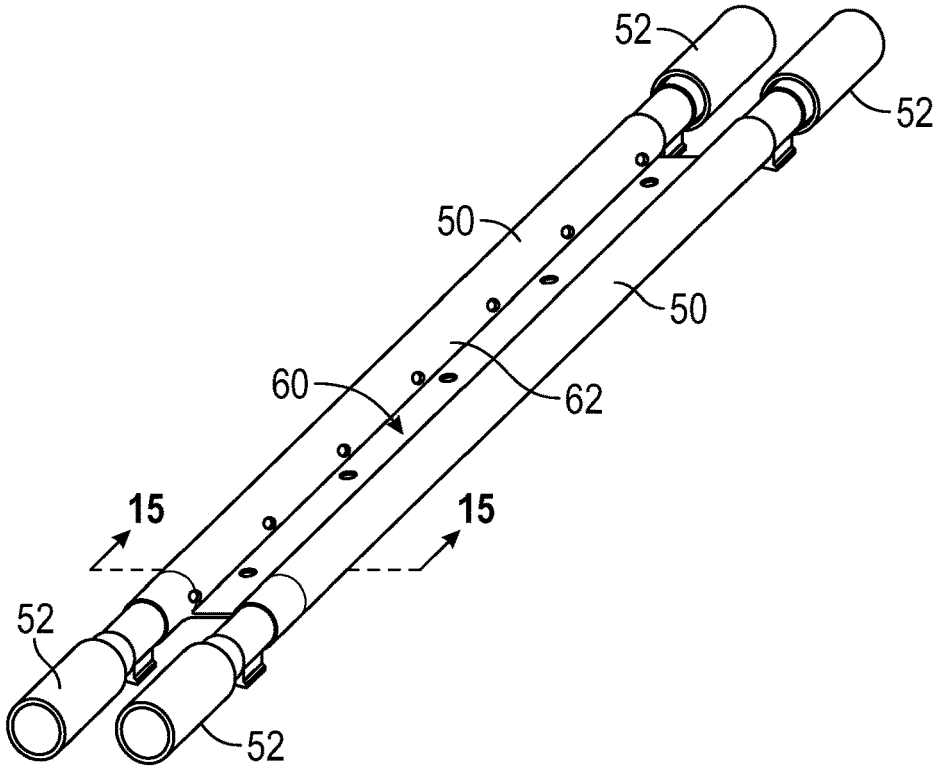
FIG. 14 is an illustration of adjacent jumper tubes combined with an anti-buckling structure, according to an embodiment of the disclosure.
Figure 15:
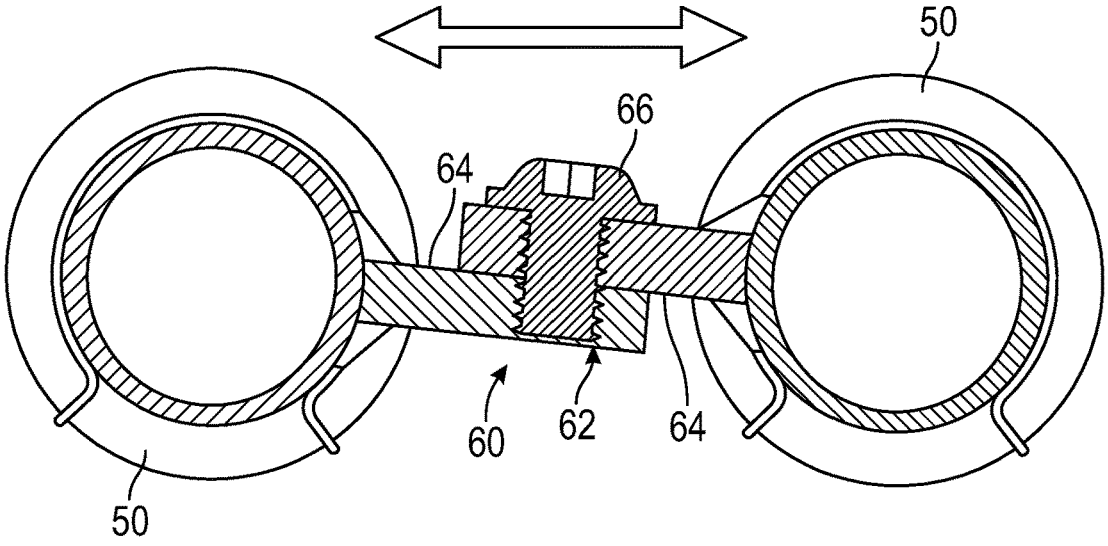
FIG. 15 is a cross-sectional illustration of adjacent jumper tubes combined with an anti-buckling structure, according to an embodiment of the disclosure.

According to one embodiment, each plate portion 64 may be welded to the corresponding jumper tube 50. The plate portions 64 of the adjacent jumper tubes 50 are then joined together to provide the connecting plate 62. The plate portions 64 may be mechanically coupled via appropriate fasteners 66, e.g. screws, positioned along their length, as illustrated in FIGS. 14-16.

In some embodiments, one or both of the plate portions 64 may be slotted so the connecting plate 62 is adjustable. For example, the plate portions 64 and thus the corresponding jumper tubes 50 may be moved closer or farther apart from each other as desired to match the tube spacing with the spacing of corresponding shunt tubes 44. The adjustability enables tubes on sequential sand screen assemblies 32 to be readily assembled even if imprecise spacing exists between shunt tubes 44. That is, the slotted plate portions 62 accommodate variable spacing between jumper tubes 50 due to manufacturing tolerances. The adjustment of plate portion 64 may be performed on, for example, the rig during assembly of the sequential screen assemblies 32 to form completion 30.

Figure 16:
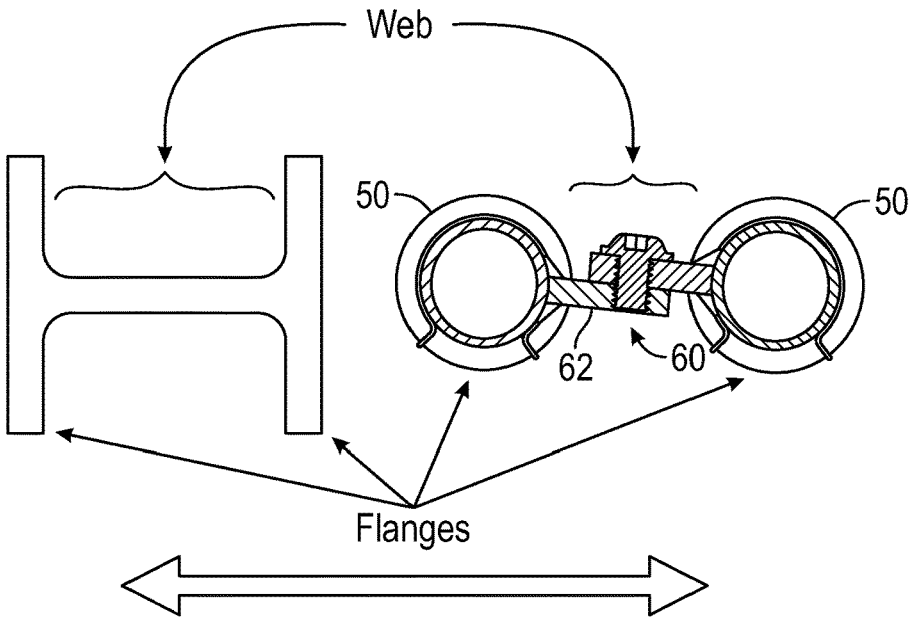
FIG. 16 is a cross-sectional illustration of adjacent jumper tubes combined with an anti-buckling structure, according to an embodiment of the disclosure.
Figure 17:
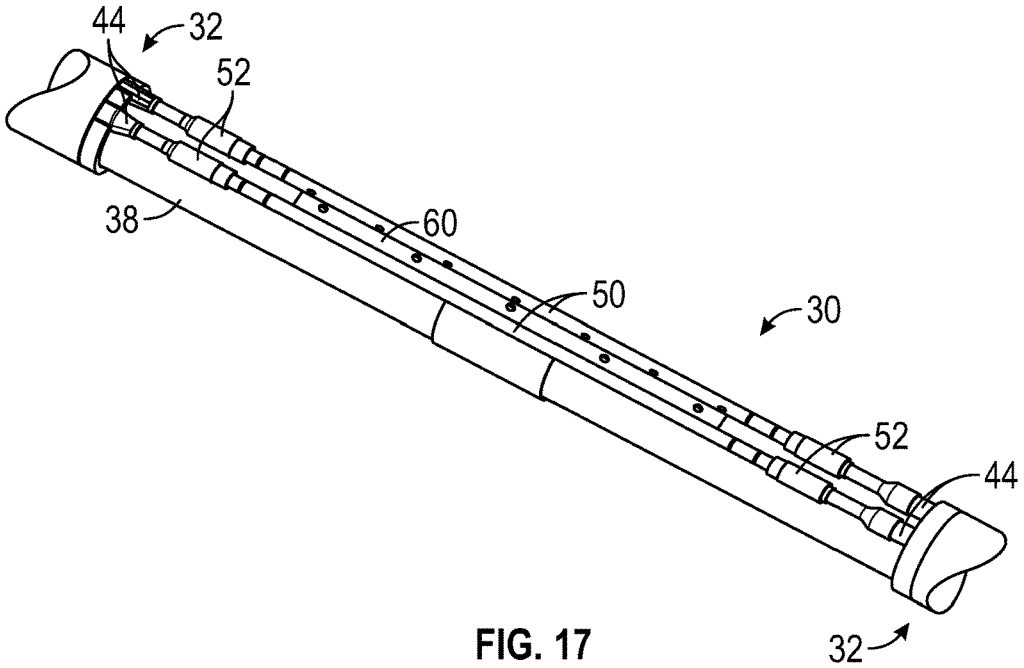
FIG. 17 is an illustration of adjacent jumper tubes combined with an anti-buckling structure and positioned along a base pipe, according to an embodiment of the disclosure.

The resulting structure, once the two jumpers 50 are coupled, resembles a structural construction shape called a wide flange beam where the connecting plate 62 performs as a web and the jumper tubes 50 perform as flanges (see FIG. 16). The structural benefit of this arrangement is that substantial lateral support is provided for the jumper tubes 50. Effectively, radial support is provided by the base pipe 38 and shroud 58 while lateral support in both side directions is provided by the anti-buckling structure 60.

If the shunt tubes 44 of the corresponding, sequential screen assemblies 32 are precisely spaced, the anti-buckling structure 60 may be made with a single plate welded to the two adjacent jumper tubes 50. In other embodiments with precise spacing available, the fasteners/screws 66 may be torqued to lock the jumper tubes 50 in their appropriate position prior to coupling the jumper tubes 50 with the corresponding shunt tube 44.

Figure 18:
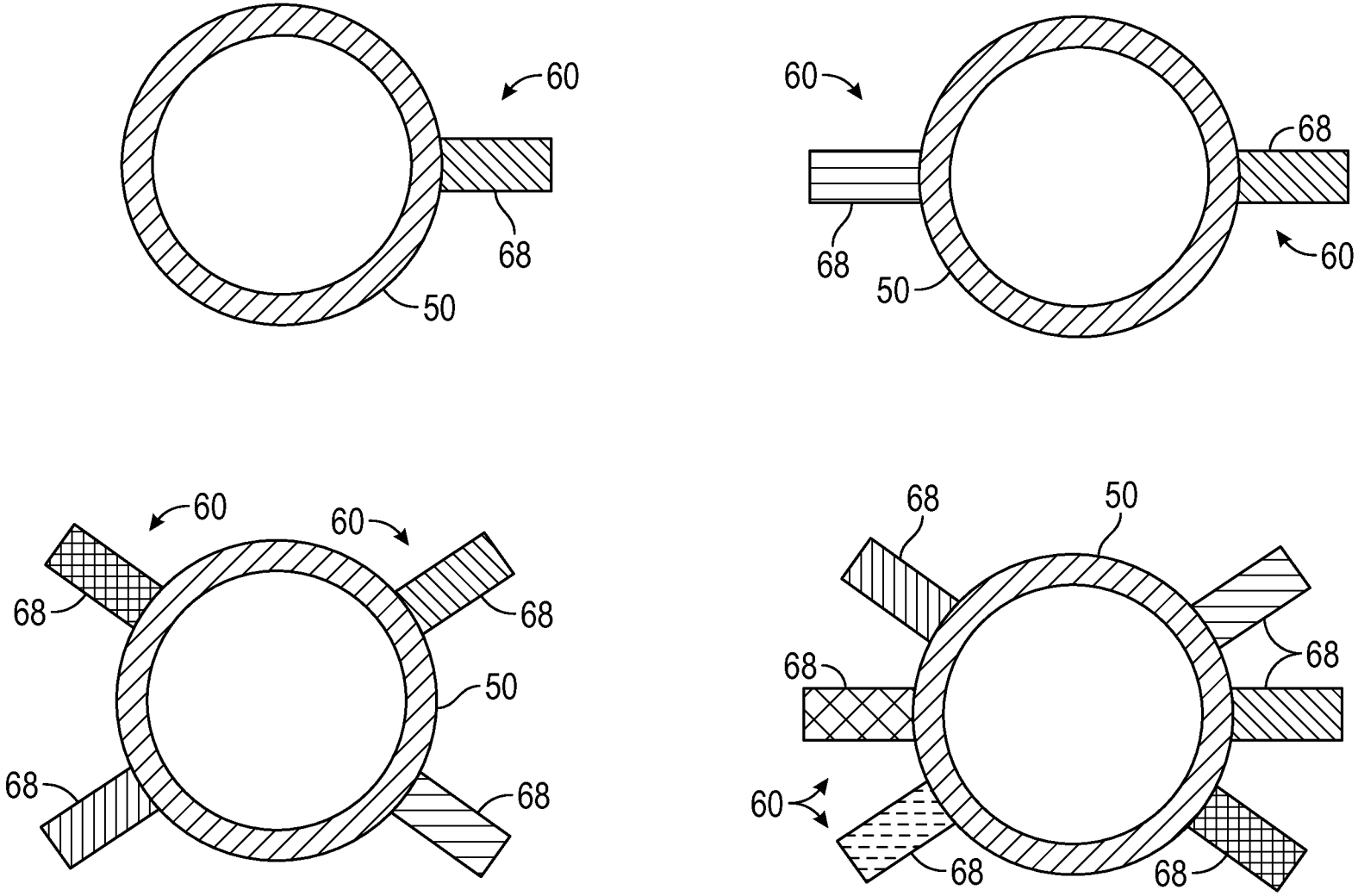
FIG. 18 is a cross-sectional illustration of examples of jumper tubes combined with another embodiment of an anti-buckling structure, according to an embodiment of the disclosure.

According to another embodiment, the anti-buckling structure 60 may be in the form of a single plate 68 or a plurality of plates 68 rigidly secured, e.g. welded, to the side wall forming each jumper tube 50, as illustrated by the examples provided in FIG. 18. Each plate 68 may be a narrow, long plate having a length between, for example, 50% and 95% of the length of the corresponding jumper tube 50. If multiple plates 68 are used, the plates 68 may be spaced around the circumference of the corresponding jumper tube 50. Depending on the embodiment, the circumferential positioning of the plates 68 is not necessarily equally spaced but rather strategically spaced to resist buckling in directions unsupported by the base pipe 38 and the shroud 58. In one or more embodiments, for example, a first plate of the plurality of plates 68 may be circumferentially positioned 180° away from a second plate of the plurality of plates 68, as shown in FIG. 18.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:
a completion system having:
a plurality of screen assemblies;
an alternate path system disposed along the plurality of screen assemblies, the alternate path system comprising shunt tubes coupled together by jumper tubes; and
an anti-buckling structure comprising a first plate affixed to a first jumper tube and coupled to a second plate affixed to a second jumper tube.

2. The system as recited in claim 1, wherein each jumper tube is positioned radially between a base pipe and a shroud.

3. The system as recited in claim 1, wherein the shunt tubes comprise transport tubes.

4. The system as recited in claim 1, wherein the shunt tubes comprise packing tubes.

5. The system as recited in claim 1, wherein the shunt tubes are generally rectangular in cross-section, and wherein the jumper tubes are generally circular in cross-section.

6. A method comprising:
carrying a gravel slurry in an alternate path system disposed along a plurality of screen assemblies, the alternate path system comprising shunt tubes coupled together by a first jumper tube and a second jumper tube, each jumper tube being affixed to an anti-buckling structure comprising a first plate affixed to the first jumper tube and coupled to a second plate affixed to the second jumper tube.

7. A method comprising:
disposing a plurality of screen assemblies in a completion system, wherein the plurality of screen assemblies comprises a first screen assembly and a second screen assembly sequentially disposed with respect to the first screen assembly; and
installing an alternate path system along the plurality of screen assemblies, wherein installing the alternate path system comprises:
running a first plurality of shunt tubes externally to a first sand screen of the first screen assembly;
running a second plurality of shunt tubes externally to a second sand screen of the second screen assembly;
using a first jumper tube and a second jumper tube to join the first plurality of shunt tubes to the second plurality of shunt tubes; and
affixing an anti-buckling structure comprising a first plate affixed to a first jumper tube and coupled to a second plate affixed to a second jumper tube.

8. The method of claim 7, wherein the shunt tubes comprise transport tubes.

9. The method of claim 7, wherein the shunt tubes are generally rectangular in cross-section, and wherein the first jumper tube and the second jumper tube are generally circular in cross-section.

* * * * *